US011293445B2

(12) United States Patent
Sheth et al.

(10) Patent No.: US 11,293,445 B2
(45) Date of Patent: Apr. 5, 2022

(54) GAS RESISTANT IMPELLER HAVING LOWER UPTHRUST FOR USE WITH A CENTRIFUGAL PUMP

(71) Applicant: Halliburton Energy Services, Inc., Houston, TX (US)

(72) Inventors: Ketankumar Kantilal Sheth, Tulsa, OK (US); Donn J. Brown, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 204 days.

(21) Appl. No.: 16/726,091

(22) Filed: Dec. 23, 2019

(65) Prior Publication Data

US 2021/0190075 A1 Jun. 24, 2021

(51) Int. Cl.

| | |
|---|---|
| ***F04D 29/22*** | (2006.01) |
| ***F04D 13/10*** | (2006.01) |
| ***E21B 43/12*** | (2006.01) |
| *F04D 1/06* | (2006.01) |

(52) U.S. Cl.

CPC ..... *F04D 13/10* (2013.01); *E21B 43/128* (2013.01); *F04D 29/22* (2013.01); *F04D 29/2205* (2013.01); *F04D 29/2222* (2013.01); *F04D 29/2288* (2013.01); *F04D 1/06* (2013.01); *F05B 2240/52* (2013.01)

(58) Field of Classification Search

CPC .. F04D 29/22; F04D 29/2205; F04D 29/2222; F04D 29/2288; F04D 13/10; F04D 1/06

See application file for complete search history.

(56) References Cited

U.S. PATENT DOCUMENTS

| | | | |
|---|---|---|---|
| 5,628,616 | A | 5/1997 | Lee |
| 6,651,740 | B2 | 11/2003 | Kobylinski et al. |
| 6,676,366 | B2 | 1/2004 | Kao |
| 6,893,207 | B2 | 5/2005 | Kao |

(Continued)

FOREIGN PATENT DOCUMENTS

| | | |
|---|---|---|
| CN | 202545343 | 11/2012 |
| JP | 2002257083 | 9/2002 |

OTHER PUBLICATIONS

Brown Lyle Wilson, et al.; "Viscous and Gas Effects on the Performance of Multistage Centrifugal Pumps"; ESP Workshop—Society of Petroleum Engineers, Gulf Coast Section; Apr. 25-29, 2011.

(Continued)

*Primary Examiner* — Courtney D Heinle
*Assistant Examiner* — Andrew J Marien
(74) *Attorney, Agent, or Firm* — McGuireWoods LLP

(57) ABSTRACT

An impeller for pumping fluid that comprises discharge flow paths that allow high pressure liquid to be used to flush out low pressure gas that can accumulate within the internal structure of the impeller. The impeller comprises transition regions, vanes, and at least one discharge flow path. The vanes are rotational about a central axis. The transition regions and the plurality of vanes have a high pressure flow path and a low pressure flow path. The at least one discharge flow path is in fluid communication with a section of the low pressure flow path of at least one of the transition region(s) and the vane(s).

17 Claims, 5 Drawing Sheets

(56) References Cited

U.S. PATENT DOCUMENTS

| | | | | |
|---|---|---|---|---|
| 10,161,411 | B1 | 12/2018 | Gottschalk et al. | |
| 2014/0178190 | A1* | 6/2014 | Gahlot | F04D 13/10 415/199.1 |
| 2016/0090992 | A1* | 3/2016 | Jayaram | E21B 43/128 415/144 |
| 2019/0040862 | A1* | 2/2019 | Ye | F04D 29/445 |
| 2019/0249526 | A1* | 8/2019 | Martinez | F04C 13/008 |

OTHER PUBLICATIONS

L. Barrios, et al.; "ESP Technology Maturation: Subsea Boosting System With High GOR and Viscous Fluids"; SPE Annual Technical Conference and Exhibition—Society of Petroleum Engineers; Oct. 8-10, 2012.

Brown Lyle Wilson, et al.; "Effect of Viscosity and Two Phase Liquid-Gas Fluids on the Performance of Multi-Stage Centrifugal Pumps"; Proceedings of ASME 2010 3rd Joint US-European Fluids Engineering Summer Meeting and 8th International Conference on Nanochannels, Microchannels, and Minichannels; Aug. 2-4, 2010.

International Search Report and Written Opinion issued in corresponding International Patent Application No. PCT/US2019/068741; dated Sep. 17, 2020.

* cited by examiner

GAS RESISTANT IMPELLER HAVING LOWER UPTHRUST FOR USE WITH A CENTRIFUGAL PUMP

BACKGROUND

ESPs (Electric Submersible Pump) are used in the production of hydrocarbon reservoirs. An ESP is a multistage centrifugal pump driven by a submersible motor and seal. A centrifugal pump include a series of rotating impellers and stationary diffusers. The impeller has several vanes for imparting mechanical energy to the fluid using centrifugal force of rotation. The centrifugal force created by the rotation of the impeller within a pump and impellers create a low pressure (LP) flow path and high pressure (HP) flow path around the vanes within the impellers. Fluid pumped from the reservoir can include a mixture of liquid and gas. Because of the pressure difference, gas can buildup in the low pressure path of impellers. This gas buildup at minimum can slow production and at maximum cause the pump to gas lock.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
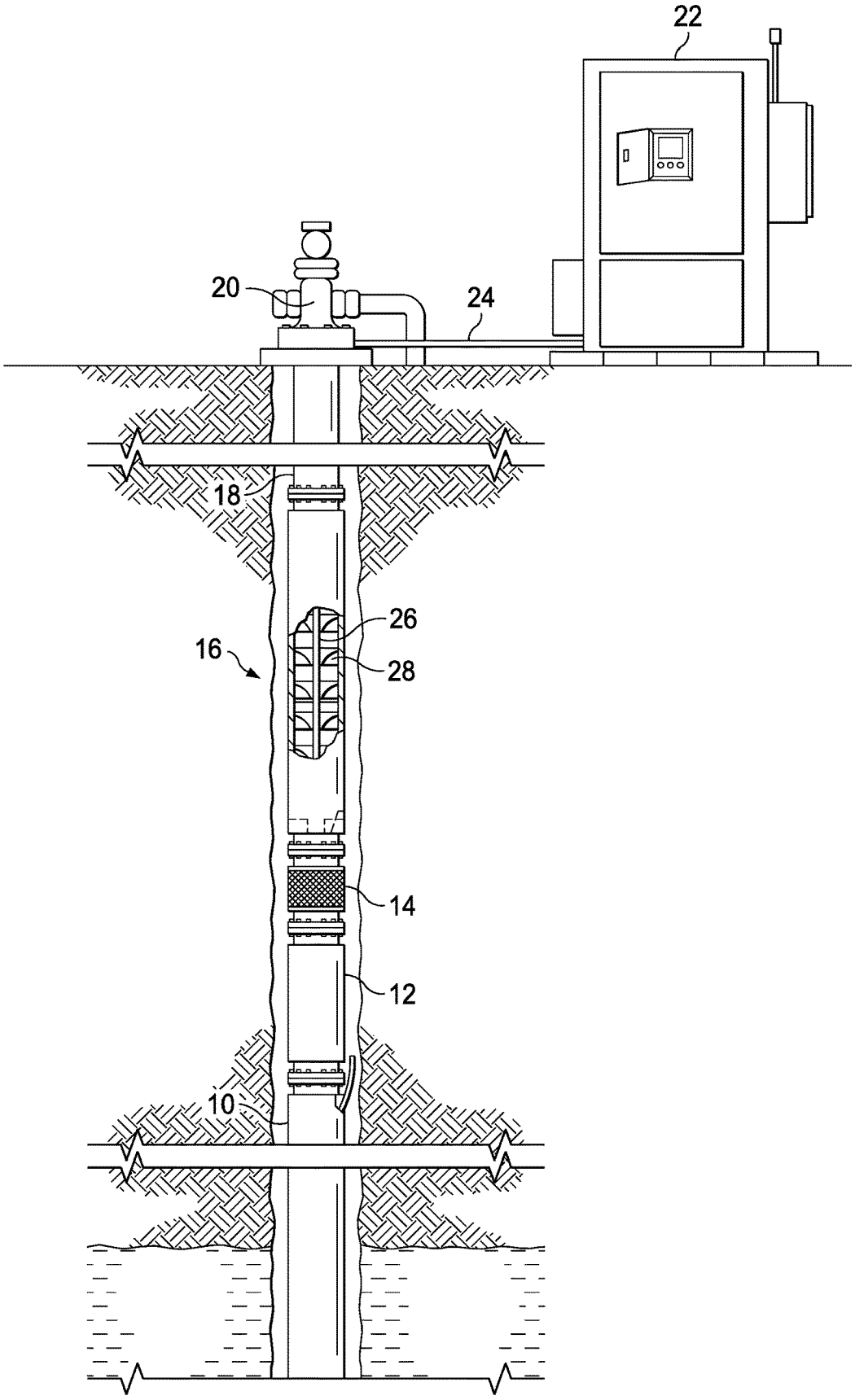
FIG. 1 is an illustration of an ESP assembly used to draw fluid from a developed reservoir, in accordance with certain example embodiments.

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

A centrifugal pump can include a rotating impeller and a stationary diffuser or volute. Each ESP stage uses a diffuser concept. An impeller is made of a shroud, hub and vanes. Some impellers can be open with vanes only while other are with vanes and hub only. The shroud and hub, connected by vanes, prevents fluid recirculation and improves impeller performance. Vanes are covered by the hub and the shroud. ESPs are multistage for producing higher pressures. An impeller provides mechanical energy to a fluid in the form of kinetic energy using centrifugal force. The rotation of the impeller vanes creates a high pressure and low-pressure area on either side of the each vane. Inlet fluid velocities near the shroud and hub are different due to different peripheral velocities based on the diameters. Generally, the shroud side inlet velocity is higher than the hub side inlet velocity. The higher shroud side inlet velocity on the low-pressure side of a vane creates a pocket of low pressure. Gas can accumulate in this area and prevent liquid from passing and, therefore, reduce liquid throughput. In gassy applications, the gas pocket can become so large that it completely blocks the inlet area and cause the pump to gas lock. This can cause significant operational delays and also affects the reliability of the pump, which can be costly to fix.

Presented herein is a disclosure of an improved gas handling and upthrust reducing impeller for use with centrifugal pumps. The impeller comprises various boreholes, i.e. apertures or hollowed out sections of the impeller shroud, that can be of any shape, strategically formed, or made, in the shroud near an inlet of the vane on the low pressure side to create a feedback flow path from high pressure fluid, coming from the leakage at the discharge side of the shroud. The high pressure fluid, in effect, flushes the gas bubbles at the low pressure side of the vane preventing the formation of a gas pocket, which can result in the gas lock of a pump.

Referring now to FIG. 1, illustrated is a diagram of an ESP assembly used to draw fluid from a developed reservoir, according to certain example embodiments. The ESP assembly comprises a motor 10, a motor protector 12, intake ports 14, and at least one centrifugal pump 16. The ESP assembly is coupled to a production tubing section 18. The production tubing section 18 carries produced fluid to wellhead 20, and then into a pipeline, storage tank, transportation vehicle and/or other storage, distribution or transportation means. A control system 22 controls ESP assembly operation by providing power and control signals to the motor 10 over a cable 24.

The motor 10 may be a two-pole, three-phase squirrel cage induction motor. The motor 10 turns the centrifugal pump 16. The motor protector 12 functions to equalize pressure and keep motor oil separate from reservoir fluid. Fluid pulled from a reservoir is circulated through the intake ports 14. The centrifugal pump 16 comprises a drive shaft 26 coupled to the motor 10 and a plurality of impellers 28 and diffusers 30. Reservoir fluid is pulled up along an axial flow path through a series of diffusers 30 and impellers 28. The impellers 28 comprise a plurality of vanes and the rotational force of the impellers 28 can segregate reservoir fluid into high pressure flow paths and low pressure flow paths, depending on the density of the fluid being drawn through the impellers 28. Gas, being lighter than the liquid, likes to get collected at the entrance of low pressure of the vane as low pressure side of vane has less ability to impart energy to the fluid than high pressure side. At least one borehole, i.e. a communication path 38 of any shape, are formed or made in the body, i.e. shroud 32, of the impellers 28 near a vane entrance on the low pressure side of the vane. The boreholes take advantage of high pressure fluid coming from running clearance, i.e. a discharge path, between the rotating impellers 28 and stationary diffusers, at the impeller exit. The communication of the high pressure liquid through the borehole into the entrance of the low pressure side of vane prevents the formation of a gas pocket that can slow or stop production altogether. The boreholes can be either drilled or formed, e.g. during a manufacturing molding process, in the body of a shroud. The borehole can be a hole, a slit, or any other type of aperture that provides a fluid flow path.

Figure 2A:
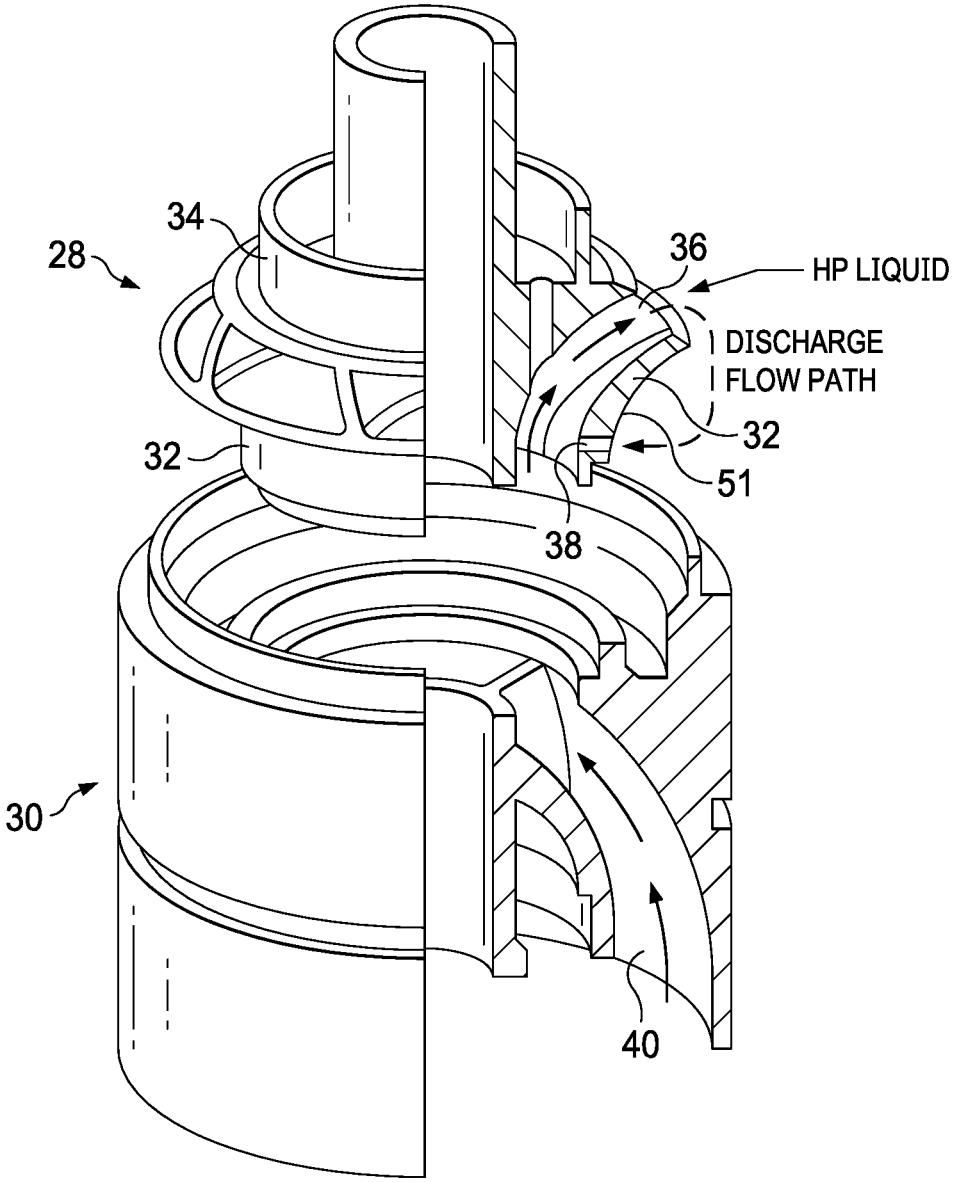
FIGS. 2A-2B are illustrations of an isometric view and a cut-away view of an impeller and a diffuser of an ESP assembly, in accordance with certain example embodiments.
Figure 2B:
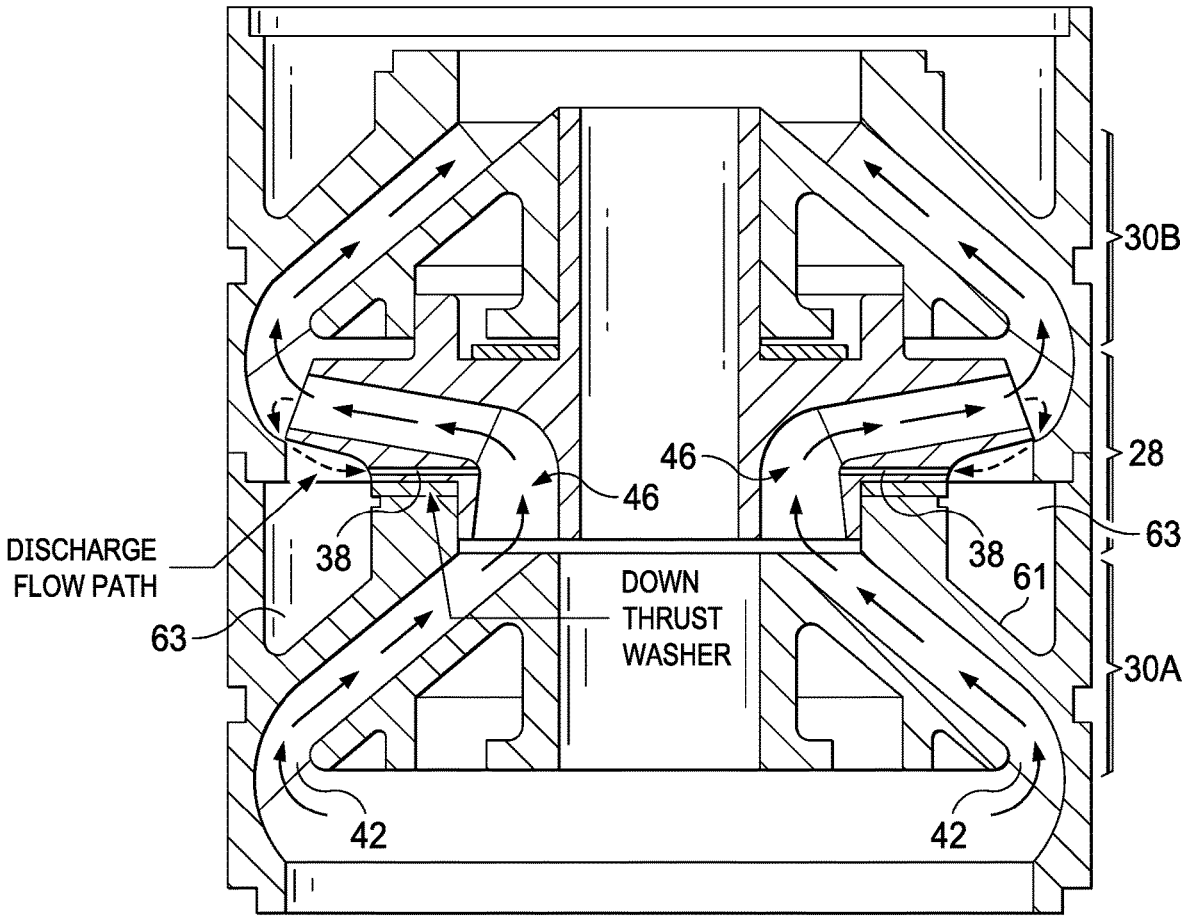

Referring now to FIGS. 2A and 2B, illustrated are an isometric view and a cut-away view of impeller 28 and a diffuser 30, according to certain example embodiments. The impeller 28 comprises a shroud 32, a hub 34, vanes 36, and boreholes 38. The impeller 28 can be seated within an Internal Diameter (ID) of the diffuser 30. While the impeller 28 is rotational about a central axis, the diffuser 30 remains stationary. In response to centrifugal forces, fluid, indicated by the arrows, traversing through the centrifugal pump 16 is segregated into a high pressure flow path on one side of the vanes 36 and a low pressure flow path on the opposite side of the vanes 36. Boreholes 38 are drilled, or otherwise formed, at locations along the shroud 38. The boreholes 38 create pressure flow paths to the low pressure sides of the vanes 36. The diffuser 30 has a spiral flow path 40 along an inner wall of the diffuser 30.

In practice, another impeller 28 can be below the diffuser 30 in FIG. 2A and, in response to centrifugal forces, fluid along the spiral flow path 40 is met with additional upward momentum due to the rotational forces of the impeller 28. The fluid traveling along the spiral flow path 40 is transferred to flow paths along the vanes 36 of the impeller 28. In practice, another diffuser 30 can be above the impeller 28 where fluid can be transferred from the flow path along the vanes 36 to another spiral flow path 40 of the other diffuser 30. As the impeller 28 is rotational inside the diffuser 30 while the diffuser 30 is stationary, a running clearance between the flow paths of the diffuser 40 and the impeller 36 exists. In FIG. 2A, as high pressure fluid is exiting the impeller 28 to enter another flow path 40 of another diffuser 40, a small amount of high pressure, discharge fluid is lost due to running clearance. The high pressure, discharge fluid naturally gravitates to the low pressure flow path of the boreholes 38. The high pressure fluid acts to flush or disrupt any gas formed along the low pressure side of the vanes 36, preventing gas pockets from forming inside the diffuser 30.

In FIG. 2B, fluid is driven into the diffuser inlets 42 and up to the impeller 28. The fluid can begin to separate into high pressure and low pressure flow paths at a transition region 46 of the impeller 28, i.e. an impeller entrance. The borehole 38 is created or formed in this region 46 of the shroud 32 and the low pressure side of the vane 36. As such, high pressure discharge fluid can be fed back to this low pressure area to disrupt gas forming along the low pressure side of the vane 36. It should understood that as long as enough discharge fluid can be recirculated back into the low pressure flow path along the low pressure side of the vane 36, where exactly the borehole 38 is created or formed in the shroud 32 may not be important. However, by creating or forming the borehole 38 at the entrance of the impeller 28 in the transition region 46, the buildup of gas is less likely to occur.

Figure 3A:
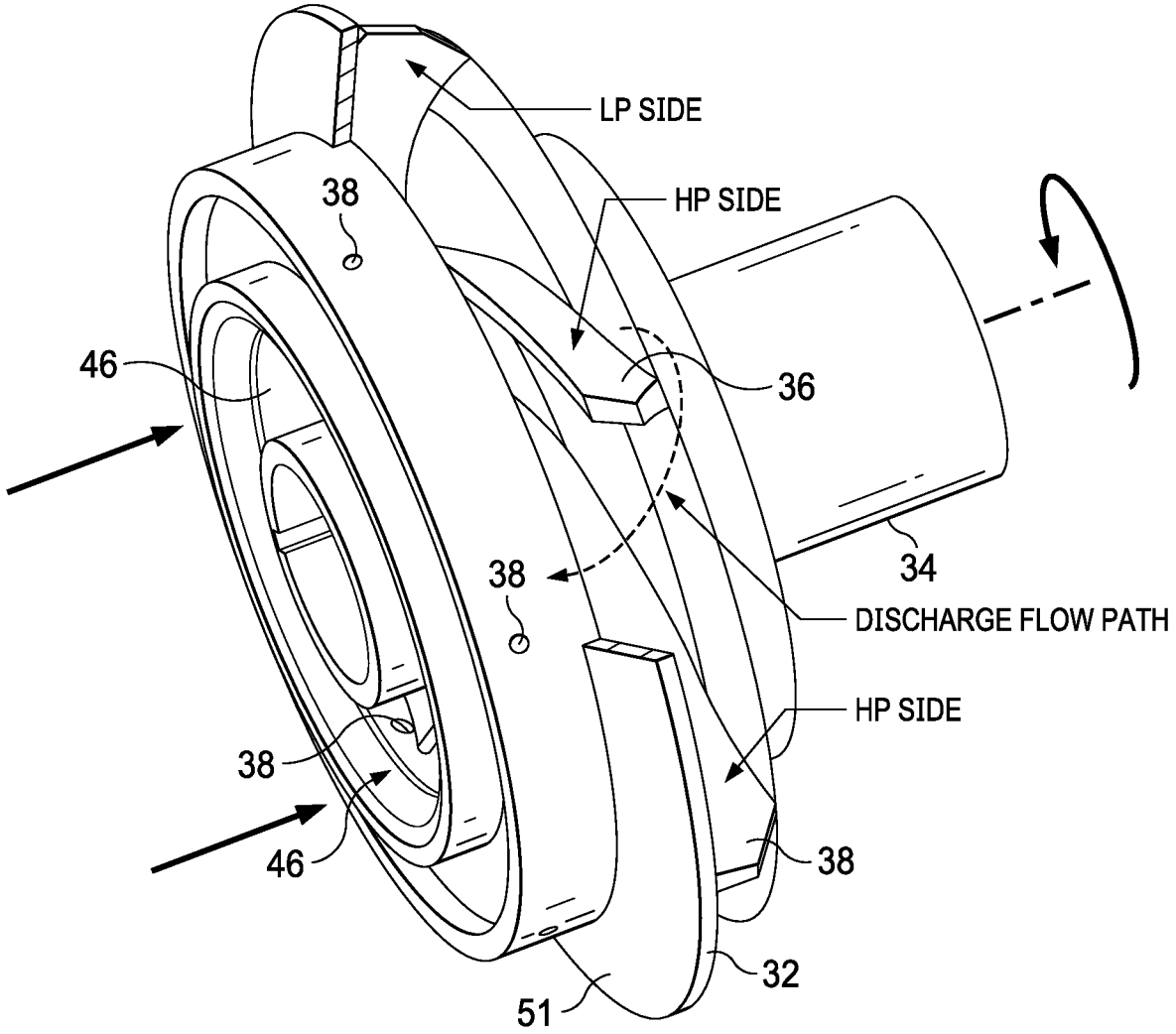
FIGS. 3A-3B are illustrations of an isometric view of the impeller and a cut-away view of the impeller.
Figure 3B:
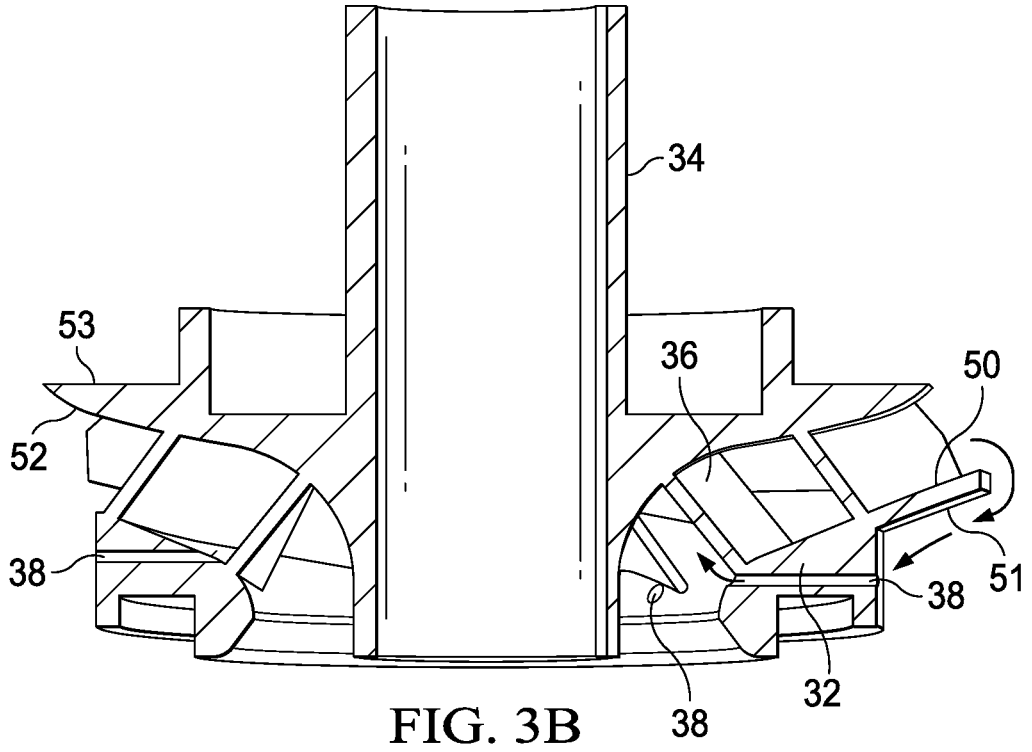
Figure 4:
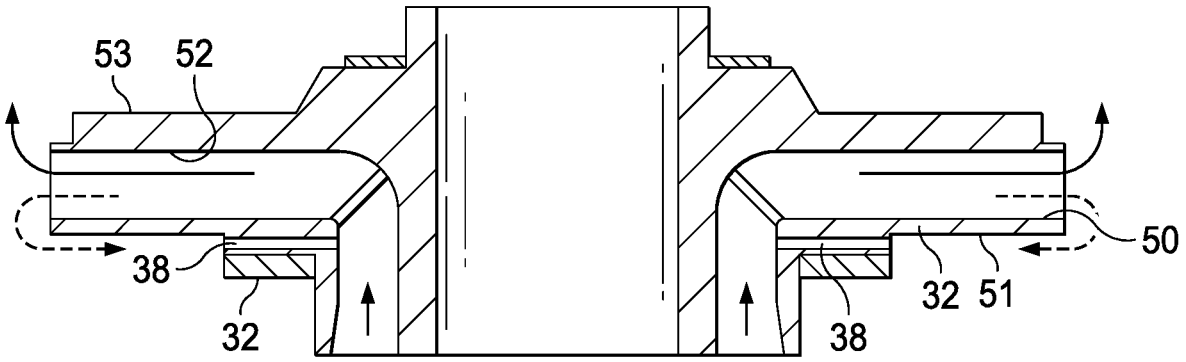
FIG. 4 is an illustration of another cut-away view of a high pressure side of a vane and a transition region of the impeller.

Referring now to FIG. 3A-3B, illustrated are an isometric view of the impeller 28 and a cut-away view of the impeller 28, according to certain example embodiments. FIG. 3A-3B represents mixed flow and axial flow impeller while FIG. 4 represents the radial flow impeller 4. In the isometric view of FIG. 3A, fluid entering the transition region 46 transitions into the high pressure liquid and low pressure gas in which the liquid gravitates to the high pressure (HP) side of the vane 36 and the gas along the low pressure (LP) side of the vane 36. The discharge liquid that escapes through the running clearance between the vanes 36 and the diffuser 30 is naturally drawn to the low pressure paths provided by the boreholes 38, which leads to low pressure sides of the vanes 36. In an embodiment, there can be one borehole 38 per vane 36 of an impeller 28, or multiple boreholes 38 per vane 38. In another embodiment, the impeller 28 can have any borehole 38 per impeller 28 ratio configuration. FIG. 3B provides an alternative view of FIG. 3A. As can be seen, the high pressure discharge liquid is drawn into the borehole 38 created or formed in the shroud 32 and to the low pressure side of the vane 36. Referring to FIG. 4, illustrated is another cut-away view of the high pressure side of the vane 36 and the transition region 46. In this particular embodiment, the borehole 38 is illustrated above what is called a downthrust washer 48 within the transition region 46. As stated previously, however, in some embodiments, the borehole 38 can be created or formed in other locations of the transition region 46 as well as along a radial flow path 50 of the vane 38.

Fluid enters the low pressure region of 46 of an impeller made by inner wall of the lower shroud 51 and inner wall of the hub 50, and then enters into the plurality of vane 36 at lower pressure. Because of the angled nature of the vanes closed by the inner wall of the lower shroud 51 and inner wall of the hub 50, it creates a high pressure and low pressure region at the entrance of the vanes. Fluid passes thru the rotating vanes and rotating vanes imparts the kinetic energy in the form of centrifugal to create high pressure, high velocity fluid that leaves from the impeller and enters into the diffuser for the further recovery of high velocity fluid into pressure by reducing the velocity.

The high pressure fluid exiting from the impeller discharge also enters thru the clearance between the rotating impeller and stationary diffuser in the region 63 bounded by the rotating outer wall of the lower shroud 51 and stationary walls 61 of the preceding diffuser. The fluid in the region 63 is partially rotating by the momentum provided by the rotating outer wall of the lower shroud of the impeller. This high pressure fluid in the region 63 is communicated thru a flow path 38 to the low pressure region 46 near the inlet side of the low pressure side of the vane. Entry of the high pressure fluid prevents and flushes away any accumulation of the bubbles of the gas contained in the fluid.

Referring FIG. 3B, additionally, because of the momentum difference of the fluid leaving and entering the fluid plus pressure differential between the inner walls, 50 and 52, of the lower shroud and the hub, and outer walls, 51 and 53, of the lower shroud and the hub creates net resultant force on the impeller. Referring FIG. 2B, if the impeller 28 moves, due to resultant force, towards the diffuser 30B then it is called upthrust and if the impeller moves towards the diffuser 30A, then it is called downthrust.

Reducing high pressure in the region 63, by allowing a flow path to low pressure region of 46, reduces the overall pressure differential on the impeller and reduces the upthrust component of the total thrust balance.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, an impeller used for pumping fluid, the impeller comprising: at least one transition region for receiving fluid from an axial flow path; a plurality of vanes rotational about a central axis and configured to radially diffuse fluid from the axial flow path; wherein the at least one transition region and the plurality of vanes have a high pressure flow path and a low pressure flow path; and at least one discharge flow path in fluid communication with a section of the low pressure flow path of at least one of the at least one transition region and at least one vane of the plurality of vanes;

Clause 2, the impeller of clause 1, wherein the discharge flow path comprises a bore at least one of formed and created in a shroud of the impeller;

Clause 3, the impeller of clause 1, wherein the fluid communication path is created to reduce at least one of a gas pocket and an up thrust;

Clause 4, the impeller of clause 1, wherein the impeller is rotational about a central axis within a stationary diffuser and the impeller and the stationary diffuser comprise an internal diameter between the plurality of vanes and an internal wall of the stationary diffuser;

Clause 5, the impeller of clause 4, wherein fluid segregates into a liquid and gas in response to a rotational force applied to the impeller and a discharge liquid exiting the plurality of vanes is fluidly coupled with the discharge flow path;

Clause 6, the impeller of clause 1, wherein the transition region comprises at least one of an axial region of the impeller and a radial region of the impeller;

Clause 7, the impeller of clause 1, wherein the plurality of vanes extend radially along a shroud of the impeller;

Clause 8, a centrifugal pump used for pumping fluid, the centrifugal pump comprising: a plurality of impellers, the impellers having: at least one transition region for receiving fluid from an axial flow path; a plurality of vanes rotational about a central axis and configured to radially diffuse fluid from the axial flow path; wherein the at least one transition region and the plurality of vanes have a high pressure flow path and a low pressure flow path; and at least one discharge flow path in fluid communication with a section of the low pressure flow path of at least one of the at least one transition region and at least one vane of the plurality of vanes;

Clause 9, the centrifugal pump of clause 8, wherein the discharge flow path comprises a bore at least one of formed and created in a shroud of the impeller;

Clause 10, the centrifugal pump of clause 8, wherein the fluid communication path is created to reduce at least one of a gas pocket and an up thrust;

Clause 11, the centrifugal pump of clause 8, wherein the impeller is rotational about a central axis within a stationary diffuser and the impeller and the stationary diffuser comprise an internal diameter between the plurality of vanes and an internal wall of the stationary diffuser;

Clause 12, the centrifugal pump of clause 11, wherein fluid segregates into a liquid and gas in response to a rotational force applied to the impeller and a discharge liquid exiting the plurality of vanes is fluidly coupled with the discharge flow path;

Clause 13, the centrifugal pump of clause 8, wherein the transition region comprises at least one of an axial region of the impeller and a radial region of the impeller;

Clause 14, the centrifugal pump of clause 8, wherein the plurality of vanes extend radially along a shroud of the impeller;

Clause 15, a method for pumping fluid, the method comprising: pumping fluid through a centrifugal pump using rotational force applied to a plurality of impellers, wherein the rotational force causes the fluid to segregate into a high pressure flow path comprising a liquid and a low pressure flow path comprising a gas; discharging a portion of the liquid through a gap between the at least one impeller and a stationary diffuser; and fluidly coupling the liquid into the low pressure flow path;

Clause 16, the method of clause 15, wherein at least one impeller comprises: at least one transition region for receiving fluid from an axial flow path; a plurality of vanes rotational about a central axis and configured to radially diffuse fluid from the axial flow path; wherein the at least one transition region and the plurality of vanes have a high pressure flow path and a low pressure flow path; and at least one discharge flow path in fluid communication with a section of the low pressure flow path of at least one of the at least one transition region and at least one vane of the plurality of vanes;

Clause 17, the centrifugal pump of clause 16, wherein the fluid communication path is created to reduce at least one of a gas pocket and an up thrust;

Clause 18, the centrifugal pump of clause 17, wherein the impeller is rotational about a central axis within a stationary diffuser and the impeller and the stationary diffuser comprise an internal diameter between the plurality of vanes and an internal wall of the stationary diffuser;

Clause 19, the centrifugal pump of clause 17, wherein the transition region comprises at least one of an axial region of the impeller and a radial region of the impeller; and Clause 20, the centrifugal pump of clause 17, wherein the plurality of vanes extend radially along a shroud of the impeller.

What is claimed is:

1. An impeller used for pumping fluid, the impeller comprising:

at least one transition region for receiving fluid from an axial flow path;

a plurality of vanes rotational about a central axis and configured to radially diffuse fluid from the axial flow path;

wherein the at least one transition region and the plurality of vanes have a high pressure flow path and a low pressure flow path;

at least one discharge flow path in fluid communication with a section of the low pressure flow path of at least one of the at least one transition region and at least one vane of the plurality of vanes;

a borehole disposed within a lower shroud of the impeller and fluidically coupled to the transition region; wherein the borehole is positioned above a downthrust washer and below the plurality of vanes and is adjacent to an entrance of the low pressure path of an individual vane within the plurality.

2. The impeller of claim 1, wherein the fluid communication path is created to reduce at least one of a gas pocket and an up thrust.

3. The impeller of claim 1, wherein the impeller is rotational about a central axis within a stationary diffuser and the impeller and the stationary diffuser comprise an internal diameter between the plurality of vanes and an internal wall of the stationary diffuser.

4. The impeller of claim 3, wherein fluid segregates into a liquid and gas in response to a rotational force applied to the impeller and a discharge liquid exiting the plurality of vanes is fluidly coupled with the discharge flow path.

5. The impeller of claim 1, wherein the transition region comprises at least one of an axial region of the impeller and a radial region of the impeller.

6. The impeller of claim 1, wherein the plurality of vanes extend radially along a shroud of the impeller.

7. A centrifugal pump used for pumping fluid, the centrifugal pump comprising:

a plurality of impellers, the impellers having:

at least one transition region for receiving fluid from an axial flow path;

a plurality of vanes rotational about a central axis and configured to radially diffuse fluid from the axial flow path;

wherein the at least one transition region and the plurality of vanes have a high pressure flow path and a low pressure flow path;

at least one discharge flow path in fluid communication with a section of the low pressure flow path of at least one of the at least one transition region and at least one vane of the plurality of vanes;

a borehole disposed within a lower shroud of the impeller and fluidically coupled to the transition region; wherein the borehole is positioned above a downthrust washer and below the plurality of vanes and is adjacent to an entrance of the low pressure path of an individual vane within the plurality.

8. The centrifugal pump of claim 7, wherein the fluid communication path is created to reduce at least one of a gas pocket and an up thrust.

9. The centrifugal pump of claim 7, wherein the impeller is rotational about a central axis within a stationary diffuser and the impeller and the stationary diffuser comprise an internal diameter between the plurality of vanes and an internal wall of the stationary diffuser.

10. The centrifugal pump of claim 9, wherein fluid segregates into a liquid and gas in response to a rotational force applied to the impeller and a discharge liquid exiting the plurality of vanes is fluidly coupled with the discharge flow path.

11. The centrifugal pump of claim 7, wherein the transition region comprises at least one of an axial region of the impeller and a radial region of the impeller.

12. The centrifugal pump of claim 7, wherein the plurality of vanes extend radially along a shroud of the impeller.

13. A method for pumping fluid, the method comprising:

pumping fluid through a centrifugal pump using rotational force applied to a plurality of impellers, wherein the rotational force causes the fluid to segregate into a high pressure flow path comprising a liquid and a low pressure flow path comprising a gas; wherein the impellers comprise:

at least one transition region for receiving fluid from an axial flow path;

a plurality of vanes rotational about a central axis and configured to radially diffuse fluid from the axial flow path;

wherein the at least one transition region and the plurality of vanes have the high pressure flow path and the low pressure flow path;

at least one discharge flow path in fluid communication with a seeders of the low pressure flow path of at least one of the at least one transition region and at least one of the plurality of vanes; and a borehole disposed within a lower shroud of the impeller and fluidically coupled to the trait si tiers region; wherein the borehole is positioned above a downthrust washer and below the plurality of varies and is adjacent to an entrance of the low pressure path of an individual vane within the plurality;

reducing at least one of a gas pocket and up thrust by discharging a portion of the liquid through the discharge flowpath between the at least one impeller and a stationary diffuser; and fluidly coupling the liquid into the low pressure flow path.

14. The centrifugal pump of claim 13, wherein the discharge flow path comprises wherein the fluid communication path is created to reduce at least one of a gas pocket and an up thrust.

15. The centrifugal pump of claim 14, wherein the impeller is rotational about a central axis within a stationary diffuser and the impeller and the stationary diffuser comprise an internal diameter between the plurality of vanes and an internal wall of the stationary diffuser.

16. The centrifugal pump of claim 14, wherein the transition region comprises at least one of an axial region of the impeller and a radial region of the impeller.

17. The centrifugal pump of claim 14, wherein the plurality of vanes extend radially along a shroud of the impeller.

* * * * *